US006428325B1

(12) United States Patent
Kurosawa et al.

(10) Patent No.: US 6,428,325 B1
(45) Date of Patent: Aug. 6, 2002

(54) ROTATABLE ELECTRICAL CONNECTOR FOR TELEPHONE CORD

(75) Inventors: Shunmei Kurosawa, Chiba; Shizuo Adachi, Kanagawa; Takahisa Rokuhara; Nobuji Hasegawa, both of Tokyo, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/343,654

(22) Filed: Jun. 29, 1999

(30) Foreign Application Priority Data

Jun. 30, 1998 (JP) ..... 10-184834

(51) Int. Cl.[7] ..... H01R 39/00
(52) U.S. Cl. ..... 439/21; 439/22
(58) Field of Search ..... 439/22, 21, 20, 439/13, 18, 26, 27, 29

(56) References Cited

U.S. PATENT DOCUMENTS 4,590,337 A * 5/1986 Engelmore ..... 179/186
5,082,448 A * 1/1992 Kang ..... 439/22
5,106,306 A * 4/1992 Ditzig ..... 439/26

* cited by examiner

*Primary Examiner*—Brian Sircus
*Assistant Examiner*—Chandrika Prasad
(74) *Attorney, Agent, or Firm*—Jay H. Maioli

(57) ABSTRACT

A connector device is formed of a case, first and second sockets housed within the case, each having on its front surface side a recess portion into which a modular connector is inserted and having a plurality of modular terminals disposed within the recess portion and a plurality of contacts conducted to the plurality of modular terminals, respectively and resiliently protruded to different positions of a rear surface side, the first socket being rotatable within the case, and a connection member whose one surface and the other surface are respectively opposed to the rear surface sides of the first and second sockets, the connection member being disposed within the case so as to become coaxial with the first and second sockets, the connection member having on the one surface a plurality of second terminals which continuously contact with the plurality of contacts of the first socket when the first socket is rotated and having on the other surface a plurality of third terminals which are respectively conducted to the plurality of second terminals and which contact with the plurality of contacts of the second socket. Thus, the connector device becomes simple in arrangement and can be mass-produced inexpensively.

4 Claims, 14 Drawing Sheets

ROTATABLE ELECTRICAL CONNECTOR FOR TELEPHONE CORD

BACKGROUND OF THE INVENTION

Field of the Invention

The present invention relates to a connector device for use with a connector device of a telephone cord for connecting a telephone body and a handset, for example.

Description of the Prior Art

Except so-called cordless telephones, a telephone body and a handset are joined by a cord comprising a bundle of a plurality of conductors, and circuits within the telephone body and circuits within the handset are connected electrically.

Most of telephone cords are of curl cord type in which a cord is molded in a coil-like shape in advance so as to become expanded and contracted when a telephone is in use.

However, the above-mentioned curl cord is easily twisted. In particular, when the curl cord is twisted like a so-called double coil, it becomes cumbersome for a user to extend the twisted curl cord up to the full length that the curl cord can be extended. Further, when the joint portion of the telephone body and the curl cord is twisted, there is the risk that the curl cord will be broken.

In order to prevent a bad effect from being caused when the curl cord is twisted as described above, heretofore, there have been developed a variety of telephone connector devices which are referred to as a handset cord twist prevention device. This connector device is of the type fitted into the cord (curl cord) for joining the telephone body and the handset.

FIG. 1 of the accompanying drawings is a perspective view illustrating an example of such a prior-art connector device.

As shown in FIG. 1, this connector device, generally depicted by reference numeral 100, comprises a connector case 101 having approximately a cylindrical shape, a connection member 110 which can be freely rotated around the axis of the case 101, a modular cord 102 comprising four conductors extendable from the rear end portion of the connection member 110 and a modular connector 103 joined to the rear end portion of this modular cord 102. In the following description, the side of the modular connector 103 of the connector device 100 will be referred to as the rear side, and the opposite side of the modular connector 103 will be referred to as the front side. In this case, an insertion aperture 101*a* having a predetermined inner diameter is defined in the inner peripheral surface of the rear end side of the connector case 101. The connection member 110 is located such that apart of a connection member rear portion 111 forming the rear half portion of the connection member 110 is projected from the insertion aperture 101*a*. The projected portion of the connection member 110 is a rear half portion 111*a* of the connection member rear portion 111. The transverse section of the rear half portion 111*a* has an outer form which is shaped as approximately an oval-shaped cylinder.

As shown in FIG. 2, the connector device 100 has a housing 130 secured to the inside of the connector case 101 to support the connection member 110 together with the connector case 101. The front half portion of the housing 130 is formed with a modular socket 131, and the modular socket 131 includes four modular terminals 132, 133, 134, 135. Also, the housing 130 includes four terminal arrangement slots 136*a*, 136*b*, 136*c*, 136*d* in which the modular terminals 132, 133, 134, 135 are located respectively. From the terminal arrangement slots 136*a* to 136*d*, there are projected the modular terminals 132, 133, 134, 135 in substantially the rear direction to form inclined portions 132*b*, 133*b*, 134*b*, 135*b* of the same length.

The in construction of the connection member 110 and the housing 130 comprising the connector device 100 will be described with reference to FIG. 3. As shown in FIG. 3, the connection member 110 is formed of three portions each molded by a synthetic resin and which are connected together coaxially. The connection member 110 comprises the connection member rear portion 111 including the rear half portion 111*a*, a cylindrical front half portion 111*b* and a disk-like flange 111*c* located at approximately an intermediate position of the outer peripheral surface of the front half portion 111*b*, a connection member front portion 112 including a disk portion 112*a* and a thin disk-like fitting protruded portion 112*b* formed at the rear surface of the disk portion 112*a* and a connection member intermediate portion 113 including a disk portion 113*a* whose size is the same as that of the disk portion 112*a*.

Moreover, the connection member 110 includes disk-band-like terminal plates 114, 115, 116, 117 having outer diameters which are approximately the same as those of the disk portions 112*a*, 113*a* and the flange portion 111*c* at predetermined positions between the disk portion 112*a*, the disk portion 113*a* and the flange portion 111*c*. To terminal plates 114 to 117, there are respectively connected one ends of four conductors 102*a*, 102*b*, 102*c*, 102*d* of the modular cord 102 by soldering in the inside. The connection member 110 has respective support rings 118, 118' of approximately annular shapes seen in the front to rear direction outwardly fitted into the front portion of a connection member intermediate portion 113 and the front portion of the flange portion 111*c*. The respective support rings 118, 118' have lower half portions 118*a*, 118'*a* in which four engagement protrusions 119*a*, 119*b*, 119*c*, 119*d* are protruded at respective ends in the circumferential directions of the outer peripheral surfaces. In the support rings 118, 118', the upper half portion 118*b*, 118'*b* and the lower half portions 118*a*, 118'*a* have different predetermined thickness and predetermined radius at the outer peripheral surface.

In the housing 130, respective portions are integrally molded by synthetic resin. The front portion of the housing 130 is comprised of a modular socket 131 and other portions are comprised of a support portion 137 which support the support rings 118, 118' and the connection member 110. The support portion 137 comprises an intermediate wall 138 and a connection member arrangement portion 139. The intermediate portion 138 comprises a circular support aperture 138*a* defined at approximately a central portion, a recess groove 138*b* extended in the upper and lower direction and whose lower end is extended to the support aperture 138*a* and whose upper end is extended to the upper end of the intermediate wall 138, two recess grooves 138*c*, 138*d* extended in the upper and lower direction and which are located at right and left positions of the recess 138*b* and an engagement pawl 138*e*. On an inner peripheral surface 139*a* of the connection member arrangement portion 139, there are formed two engagement grooves 140*a*, 140*b* spaced apart from each other in the front and rear direction and extended along the peripheral direction and which are engaged with outer peripheral portions of the lower half portions 118*a*, 118'*a* of the support rings 118, 118'. Further, the connection member arrangement portion 139 has on its peripheral wall formed four engagement apertures 141*a*, 141*b*, 141*c*, 141*d* of approximately rectangular shapes which are engaged with the four engagement protrusions 119*a*, 119*b*, 119*c*, 119*d*, respectively.

The connection member arrangement portion 139 has at its predetermined positions formed four terminal insertion apertures 142, 143, 144, 145 (only the terminal insertion aperture 144 is shown in FIG. 3) corresponding to the four modular terminals 132, 133, 134, 135. From these terminal insertion apertures 142, 143, 144, 145, there are projected erect portions 132*c*, 133*c*, 134*c*, 135*c* of approximately the same length which are upwardly extended from the rear ends of the respective modular terminals 132, 133, 134, 135.

FIG. 4 shows a main portion of the internal arrangement of the connection member 110. As shown in FIG. 4, four relatively small spring arrangement holes 120*a*, 121*a*, 122*a*, 123*a* are bored on the support rings 118, 118' at their surfaces opposite to each other along the axis direction of the bottom portions in such a manner that their transverse sections are circular and that they are extended in the direction parallel to the axis direction. The four spring arrangement holes 120*a*, 121*a*, 122*a*, 123*a* are used to locate four springs 120, 121, 122, 123 therein. These spring arrangement holes 120*a*, 121*a*, 122*a*, 123*a* are disposed by the pair on the support rings 118, 118' at predetermined positions spaced apart from one another.

On the surfaces in which the spring arrangement holes 120*a* to 123*a* are defined, there are formed slits 120*b*, 121*b*, 122*b*, 123*b* which are extended in the upper and lower direction in correspondence with the spring arrangement holes 120*a* to 123*a*, respectively. The slits 120*b*, 121*b*, 122*b*, 123*b* are formed on the surface opposite to the surfaces in which the spring arrangement holes 120*a* to 123*a* are opened. The upper and lower ends of the slits 120*b*, 121*b*, 122*b*, 123*b* are extended up to the inner peripheral surfaces of the support rings 118, 118' and the outer peripheral surfaces of the lower half portions 118*a*, 118'*a*, and the deep end portions thereof are positioned so as to cross the deep end portions of the spring arrangement holes 120*a* to 123*a*. A protruded portion 112*c*, which is cylindrical in the axis direction and which is protruded from the central portion of the front surface is formed on the connection member front portion 112 of the connection member 110.

The connection member 110 and the housing 130 are arranged as described above. The connection member 110 is supported to the housing 130 in such a manner that the protruded portion 112 protruded from the connection member front portion 112 is fitted into a support aperture 13*a* of the housing 130 so as to become freely rotatable, the outer peripheral portions of the lower half portions 118*a*, 118'*a* of the support rings 118, 118' are engaged with the engagement grooves 140*a*, 140*b* and the respective engagement protrusions 119*a* to 119*d* are respectively engaged with engagement apertures 141*a* to 141*d* defined on the peripheral all of the connection member arrangement portion 139. Then, the rear portion of the flange portion 111*c* of the connection member 110 is rotatably supported to the insertion aperture 101*a* of the connector case 101, whereby the connection member 110 is supported to the housing 130 and the connector case 101 so as to become freely rotatable around is the axis direction.

FIG. 5 shows the internal arrangement of the connector device 100. As shown in FIG. 5, with respect to the terminal plates 114 to 117 of the connection member 110, the terminal plate 114 is outwardly fitted into the engagement protruded portion 113*b* of the front side of the connection member intermediate portion 113; the terminal plate 115 is outwardly fitted into the engagement protruded portion 112*b* of the connection member front portion 112; the terminal plate 116 is outwardly fitted into the engagement protruded portion 113*c* of the rear side of the connection member intermediate portion 113; and the terminal plate 117 is outwardly fitted into the engagement protruded portion 111*d* of the connection member rear portion 111, respectively. Also, the terminal plates 114, 115, 116, 117 include connection tabs 114*a*, 115*a*, 116*a*, 117*a* which are extended from the inscribed circles of these terminal plates 114, 115, 116, 117 in the direction parallel to the axis direction. One ends of the four conductors 102*a*, 102*b*, 102*c*, 102*d* of the modular cord 102 are separately soldered to these connection tabs 114*a*, 115*a*, 116*a*, 117*a*.

Four modular terminals 132, 133, 134, 135 of the housing 130 comprise intermediate portions 132*a*, 133*a*, 134*a*, 135*a* of different lengths extended in the front and rear direction, inclined portions 132*b*, 133*b*, 134*b*, 135*b* of the same length extended from the front end to approximately the rear direction and erect portions 132*c*, 133*c*, 134*c*, 135*c* of approximately the same length extended from the rear ends of the intermediate portions 132*a*, 133*a*, 134*a*, 135*a* to the upper direction. The erect portions 132*c*, 133*c*, 134*c*, 135*c* are separately inserted into the slit 5 120*b*, 121*b*, 122*b*, 123*b* formed on the support rings 118, 118', and their portions near the upper ends are positioned at the deep end portions of the corresponding spring arrangement holes 120*a*, 121, 122*a*, 123*a*, respectively. Also, respective coil springs 120, 121, 122, 123 are placed such that they are contracted between the erect portions 132*c*, 133*c*, 134*c*, 135*c* positioned at the deep end faces of the spring arrangement holes 120*a*, 121*a*, 122*a*, 123*a* and the corresponding assemblies 132, 133, 134, 135.

Specifically, the respective erect portions 132*c*, 133*c*, 134*c*, 135*c* are respectively brought in contact with loops of one ends of the respective coil springs 120, 121, 122, 123, and are inserted into the slits 120*b*, 121*b*, 122*b*, 123*b* while slightly urging the other ends of the coil springs 120, 121, 122, 123 against the terminal plates 132, 133, 134, 135. Accordingly, the modular terminals 132, 133, 134, 135, disposed within the corresponding housings 130 and the respective conductors 102*a*, 102*b*, 102*c*, 102*d* of the modular cord 102 disposed in the connection member 110 are electrically connected together through the terminal plates 132, 133, 134,135 and the contracted coil springs 120, 121, 122, 123.

According to the above-mentioned arrangement, the modular cord 102 can be freely rotated in the axis rotating direction with respect to the connector case 101 and another modular cord coupled to the modular cord 102. When the modular cord 102 is rotated, the respective terminal plates 132, 133, 134, 135 and the respective coil springs 120, 121, 122, 123 are relatively slid so that they can be brought in constant contact with each other. Thus, when the modular cord 102 and another modular cord or one of them is applied with a twisting force, the modular cord 102 is integrally rotated with the connection member 101 and thereby prevented from being twisted.

However, since the above-mentioned connector device has a number of assemblies and a complicated structure, it is unavoidable that much labors and efforts are required when such connector device is manufactured. Furthermore, since the expensive materials such as the coil springs are indispensable to the above-mentioned connector device, the connector device becomes expensive and cannot be mass-produced accordingly.

SUMMARY OF THE INVENTION

In view of the aforesaid aspect, it is an object of the present invention to provide a connector device of a simple arrangement which can be made suitable for mass-production.

According to an aspect of the present invention, there is provided a connector device which is comprised of a case, first and second sockets housed within the case, each having on its front surface side a recess portion into which a modular connector is inserted and having a plurality of modular terminals disposed within the recess portion and a plurality of contacts connected to the plurality of modular terminals, and resiliently protruded to different positions of a rear surface side, the first socket being rotatable within said case, and a connection member whose one surface and the other surface are respectively opposed to the rear surface sides of the first and second sockets, the connection member being disposed within the case so as to become coaxial with the first and second sockets, the connection member having on the one surface a plurality of second terminals which continuously contact with the plurality of contacts of the first socket when the first socket is rotated and having on the other surface a plurality of third terminals which are respectively connected to the plurality of second terminals and which contact with the plurality of contacts of the second socket.

According to the present invention, a telephone cord can be prevented from being twisted by the simple arrangement having less assemblies.

DESCRIPTION OF THE PREFERRED EMBODIMENT

A connector device according to an embodiment of the present invention will hereinafter be described with reference to FIGS. 6 to 17.

The connector device according to this embodiment is able to prevent a curl cord from being twisted by connecting a handset connecting modular socket of a telephone body, for example, and a modular connector of the other end of the curl cord whose one end is connected to the handset.

Figure 1:
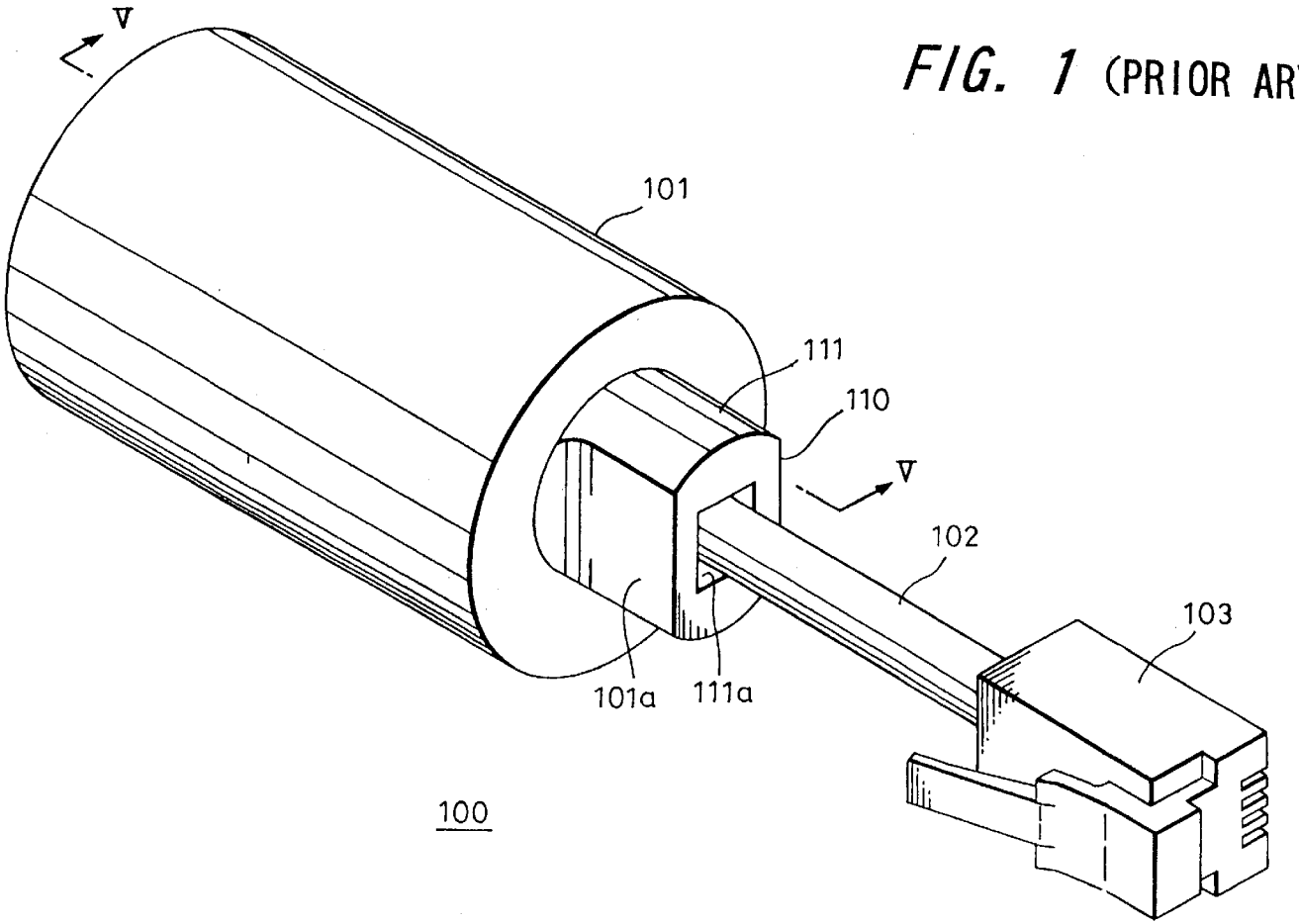
FIG. 1 (PRIOR ART)
FIG. 1 is a perspective view illustrating an example of a connector device according to the prior art.
Figure 2:
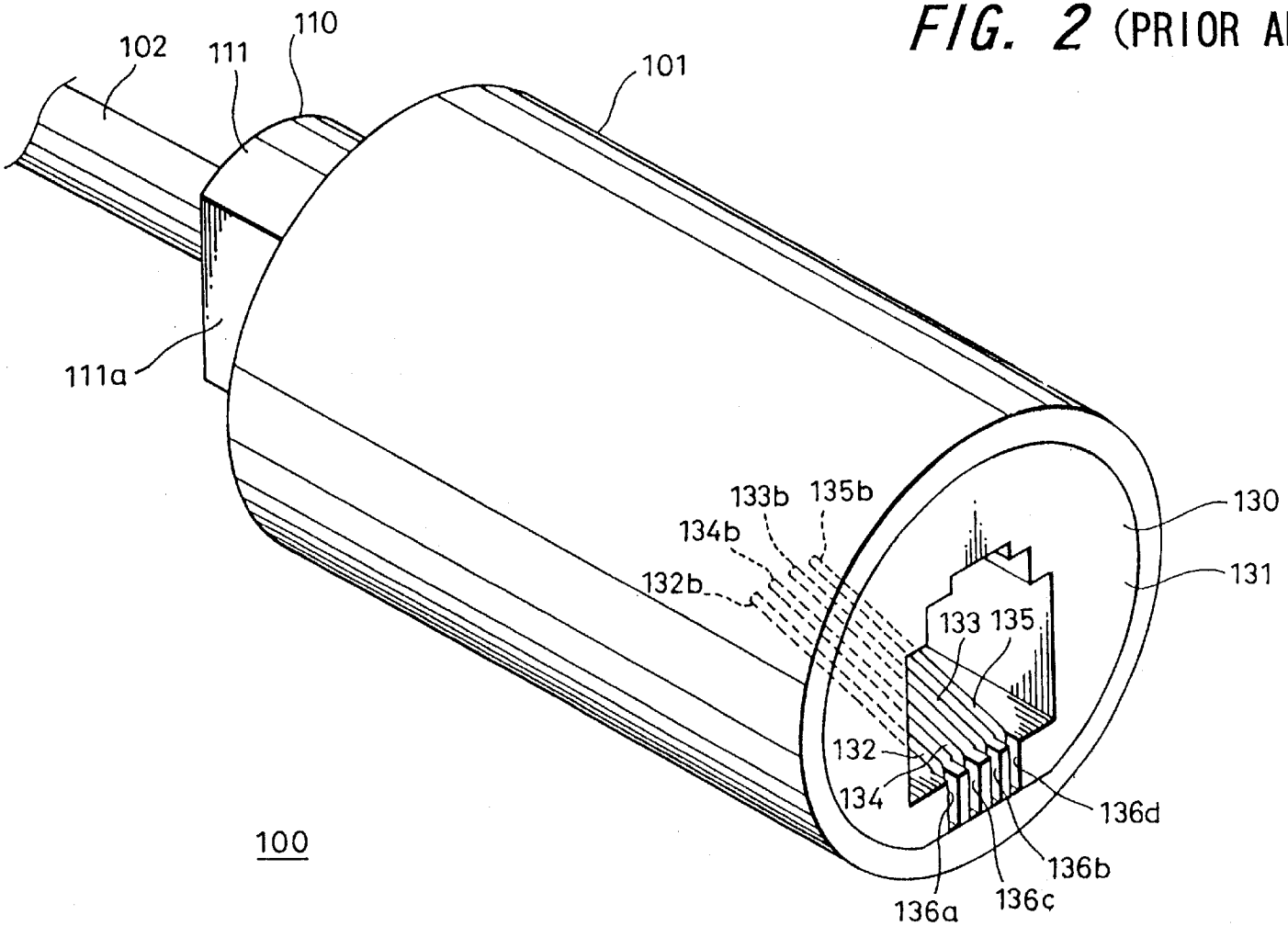
FIG. 2 (PRIOR ART)
FIG. 2 is a perspective view illustrating an example of the connector device according to the prior art.
Figure 3:
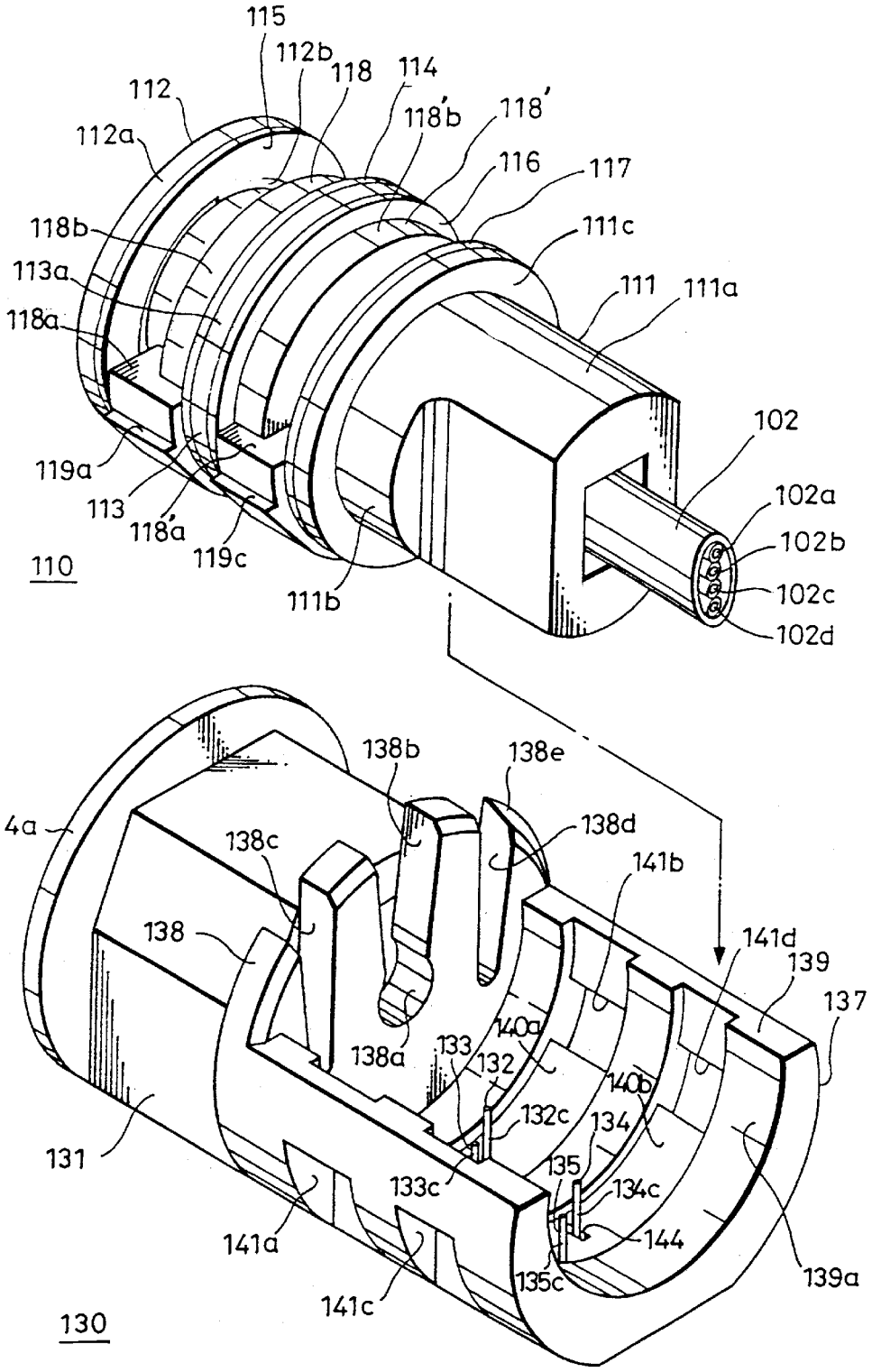
FIG. 3 (PRIOR ART)
FIG. 3 is an exploded perspective view illustrating examples of a connection member and a housing of the connector device according to the prior art.
Figure 4:
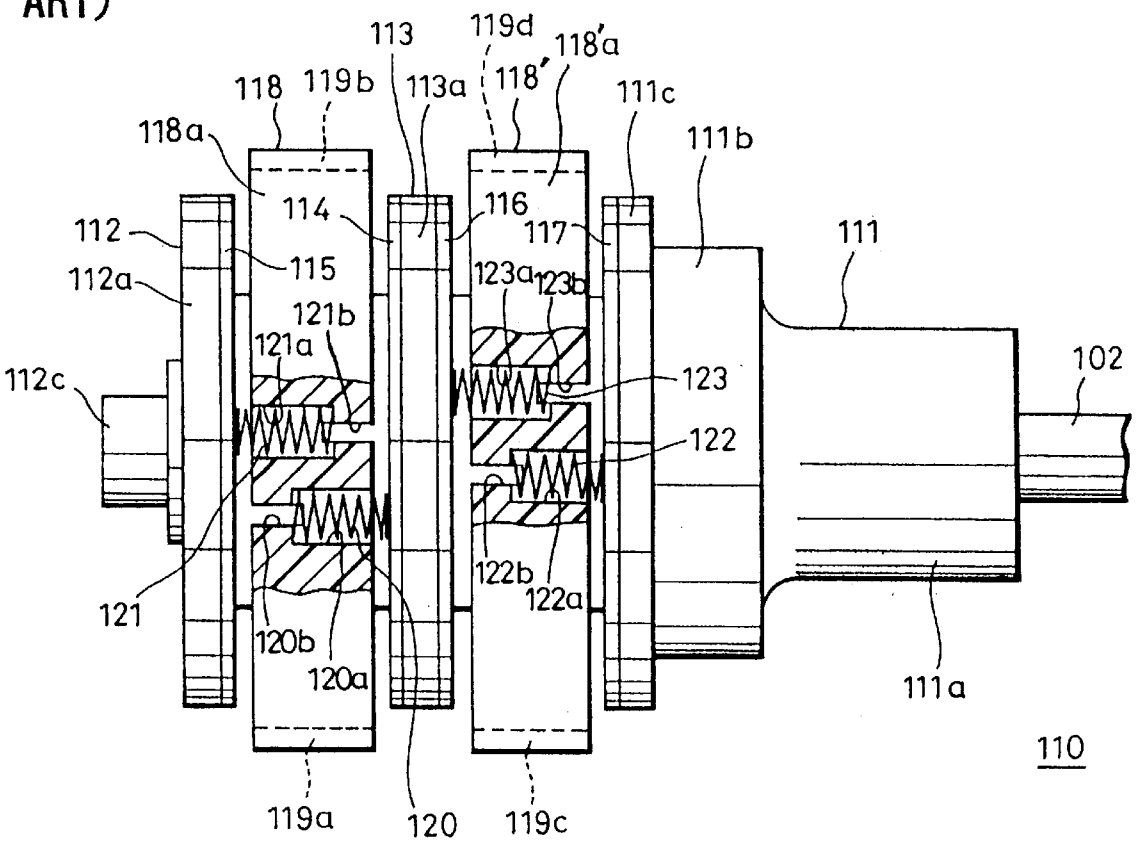
FIG. 4 (PRIOR ART)
FIG. 4 is a partly cutaway plan view illustrating an example of a connection member of the connector device according to the prior art.
Figure 5:
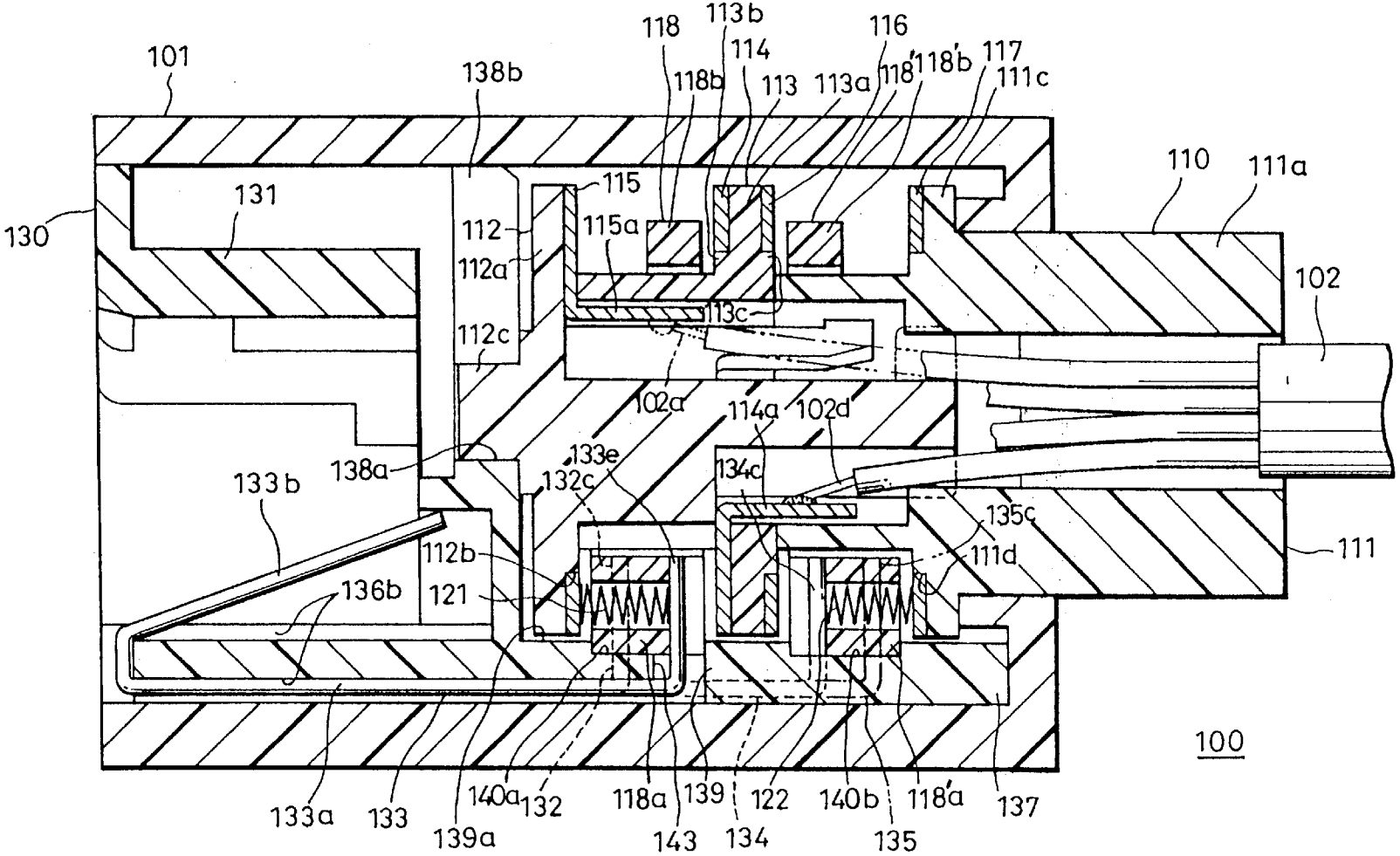
FIG. 5 (PRIOR ART)
FIG. 5 is a cross-sectional view taken along the line V—V in FIG. 1, and illustrating an example of the connector device according to the prior art.
Figure 6:
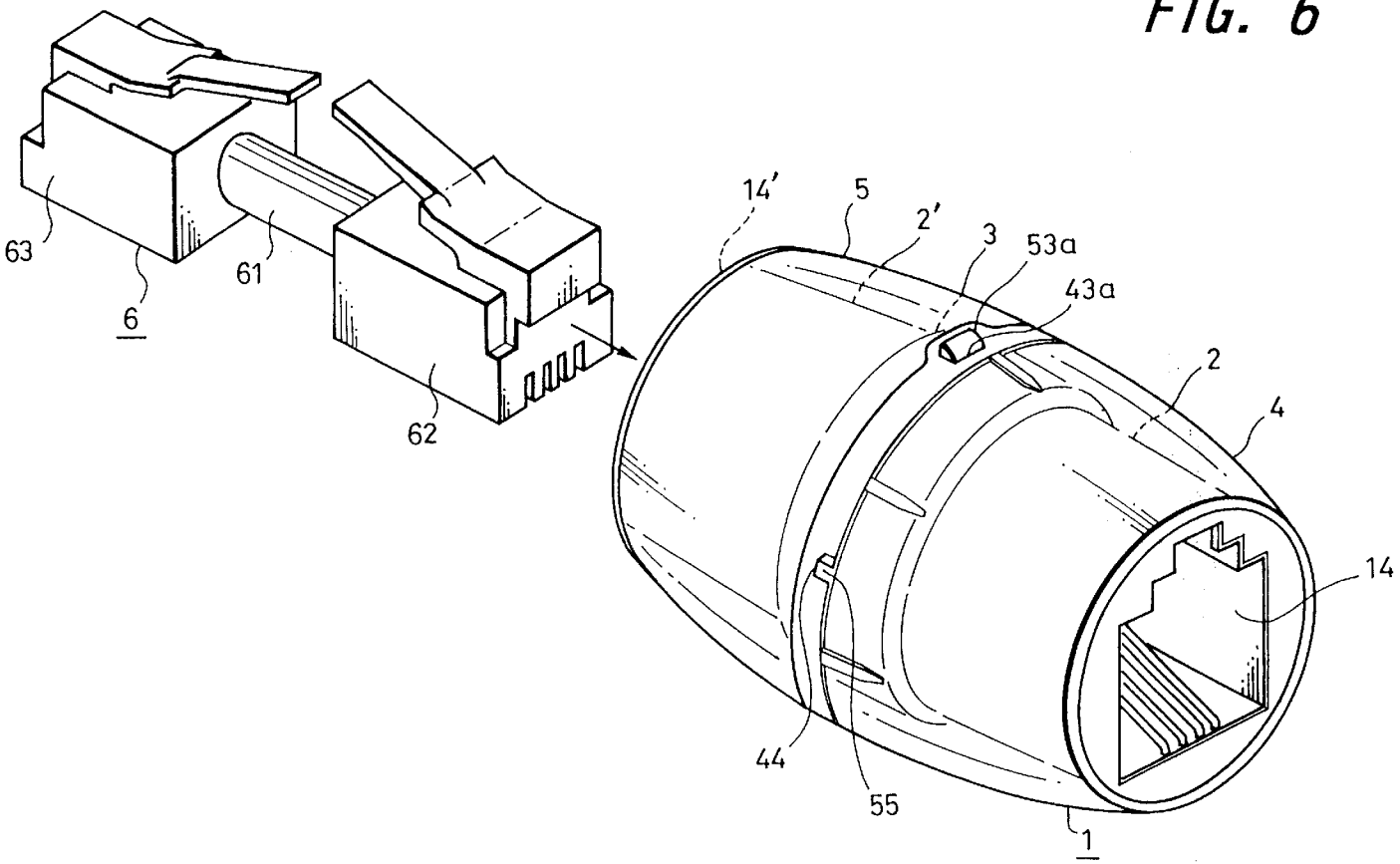
FIG. 6 is a perspective view illustrating an arrangement of a connector device according to an embodiment of the present invention.

FIG. 6 is a perspective view showing a connector device 1 in the assembled state and a plug device 6 which is connected to the connector device 1 when in use. As shown in FIG. 6, the connector device 1 comprises two cases 4, 5, fastened by a suitable means (not shown), in which there are disposed two modular sockets 2, 2' and a connection member 3 for joining the two modular sockets 2, 2'. The two modular sockets 2, 2' respectively have on their end portions formed connector coupling recesses 14, 14' (the recess 14' is located at the rear-side position in FIG. 6) into which modular connectors are inserted, respectively.

When this connector device 1 is used as a twisting prevention device, there is prepared a plug device 6. As shown in FIG. 6, this plug device 6 comprises a modular cord 61 having a length of approximately several centimeters and modular connectors 62, 63 connected to respective ends of the modular cord 61. Then, the modular connector of the curl cord is inserted into one connector coupling recess 14 of the connector device 1, for example, and one modular connector 62 of the plug device 6 is inserted into the other connector coupling recess 14' of the connector device 1. Then, the other modular connector 63 of the plug device 6 is inserted into the handset connection modular socket of the telephone body when the connector device 1 is in use. In the connector device 1 according to this embodiment, one modular socket 2 within the cases 4, 5 is made freely rotatable with respect to the connection member 3 and the other modular socket 2', and the curl cord can be prevented from being twisted by the rotation of this modular socket 2.

Figure 7:
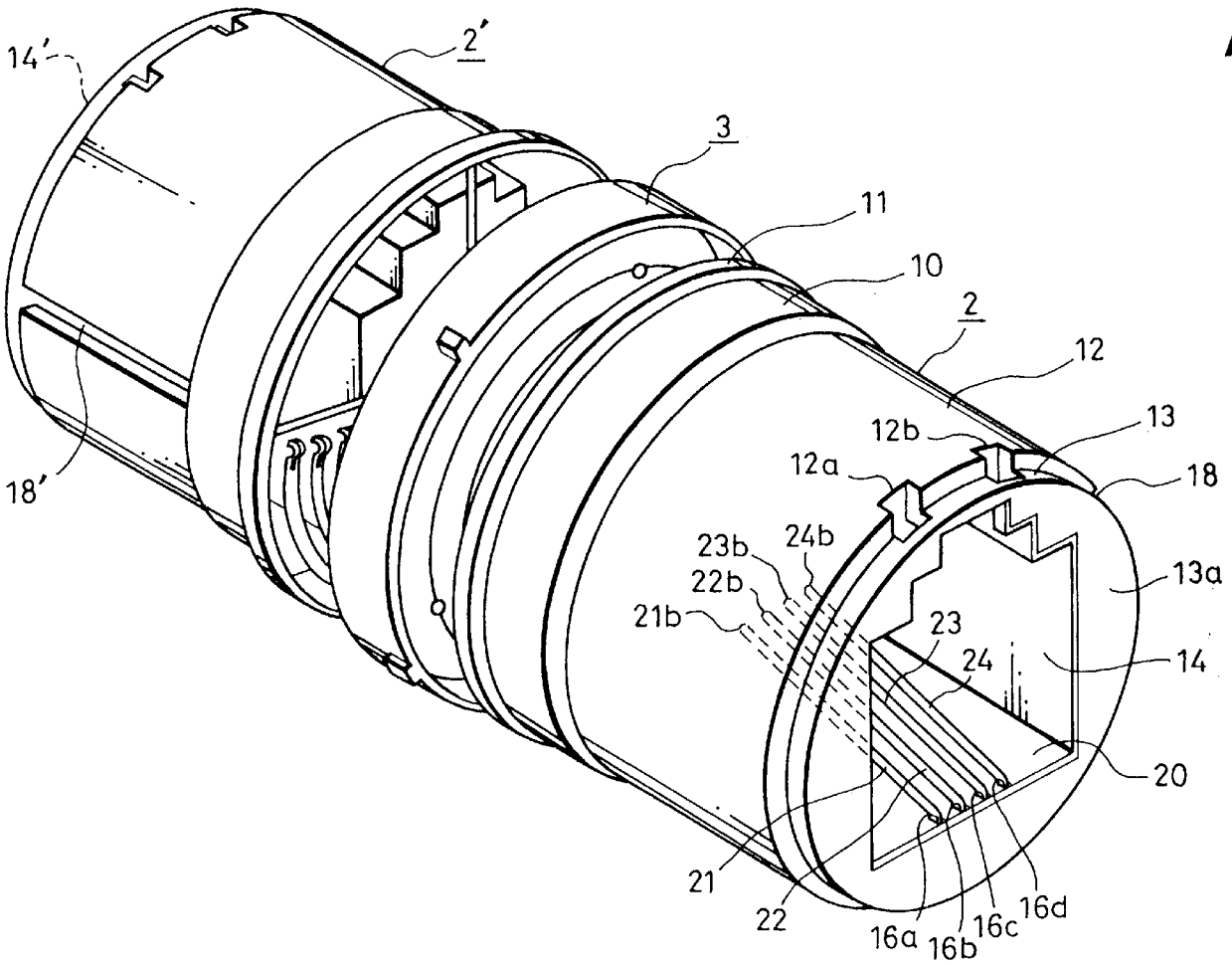
FIG. 7 is a perspective view illustrating examples of arrangements of a modular socket and a connection member according to the embodiment of the present invention.

FIG. 7 shows the modular sockets 2, 2' and the connection member 3 disposed within the cases 4, 5. As shown in FIG. 7, in this embodiment, the modular sockets 2 and 2' have approximately the same configuration and the connection member 3 joins these modular sockets 2, 2' in such a manner that the modular sockets 2, 2' are kept to be coaxial. In the following description, with respect to the modular sockets 2', elements and parts identical to those of the modular socket 2 are marked with reference numerals of the modular socket 2 with a prime mark, (').

Moreover, in the following description, the side of the modular socket 2 represents the front side, the side of the modular socket 2' represents the rear side, and the upper and lower direction is represented in exactly the same manner as that shown in FIG. 7.

The modular socket 2 is integrally molded by a synthetic resin, for example. The outer configuration of the modular socket 2 comprises a rear half portion (hereinafter referred to as a modular socket rear portion) 10 of approximately a cylindrical shape, a rear end portion 11 of an annular shape with an outer diameter smaller than that of the modular socket rear portion 10 and whose inner diameter is slightly smaller than that of the modular socket rear portion 10, the rear end portion 11 being slightly protruded from the modular socket rear portion 10 in the rearward, a front half portion (hereinafter referred to as a modular socket front portion) 12 of approximately a cylindrical shape having an outer diameter slightly smaller than that of the modular socket rear portion 10, a front end portion 13 having an outer diameter slightly smaller than that of the modular socket front portion 12 and which is projected from the modular socket front portion 12 in the front direction and the connector coupling recess 14 opened at a front end surface 13*a* of the front end portion 13 and which can detachably couple the modular connector (not shown) of the curl cord, for example. Incidentally, the rear end portion 11, the modular socket rear portion 10, the modular socket front portion 12 and the front end portion 13 are formed so as to become coaxial with one another and have predetermined stepped differences at their boundary portions. The modular socket 2 has at upper predetermined portions predetermined holes 12*a*, 12*b* bored in the vertical direction across the boundary portion between the front portion 12 and the front end portion 13.

As shown in FIG. 7, in this embodiment, the modular socket 2 includes a terminal portion 20 having four modular terminals 21, 22, 23, 24. Also, the modular socket 2 includes four long terminal arrangement grooves 16*a*, 16*b*, 16*c*, 16*d* in which the respective modular terminals 21, 22, 23, 24 are disposed. Inclined portions 21*b*, 22*b*, 23*b*, 24*b* of the modular terminals 21, 22, 23, 24 and which are the same length extended in approximately the rear direction are protruded from the terminal arrangement grooves 16*a*, 16*b*, 16*c*, 16*d*.

Figure 8:
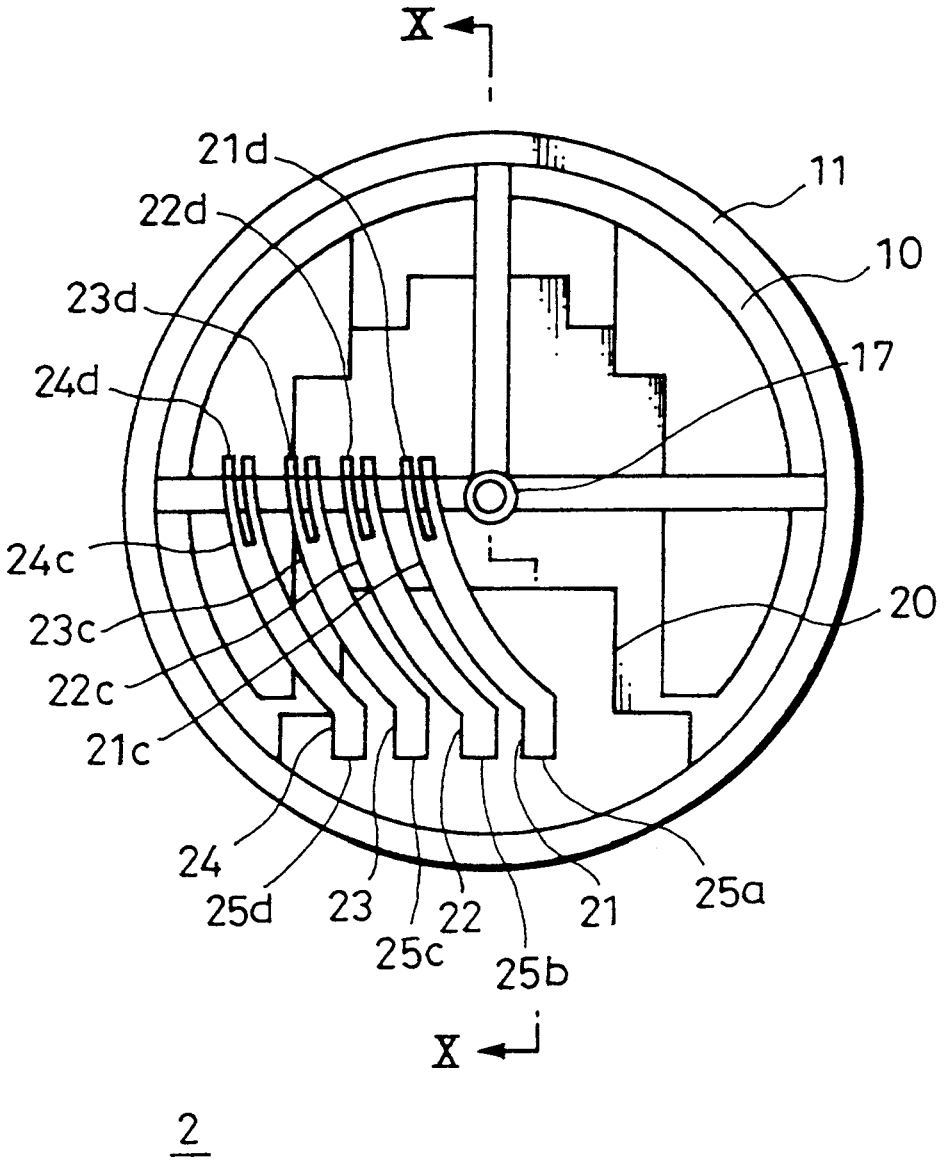
FIG. 8 is a rear view illustrating an example of an arrangement of a modular socket according to an embodiment of the present invention.

As shown in FIG. 8, the terminal portion 20 of the modular socket 2 includes four terminal arrangement grooves 25*a*, 25*b*, 25*c*, 25*d* in which the modular terminals 21, 22, 23, 24 are disposed, respectively. In this embodiment, there are protruded erect portions 21*c*, 22*c*, 23*c*, 24*c* of the modular terminals 21, 22, 23, 24 approximately upward from the terminal arrangement grooves 25*a*, 25*b*, 25*c*, 25*d*, and which are substantially the same in length extended so as to draw approximately a part of a concentric circle. Also, the modular socket 2 has on its rear surface a protruded portion 17 of approximately a cylindrical shape projected rearwardly from the axis of approximately the circular rear surface. In this embodiment, the tip end portions of the erect portions 21*c*, 22*c*, 23*c*, 24*c* include hook-like sliding contact portions 21*d*, 22*d*, 23*d*, 24*d*, respectively. In this embodiment, each of the sliding contact portions 21*d*, 22*d*, 23*d*, 24*d* is bifurcated from the tip end by a break, for example.

Figure 9:
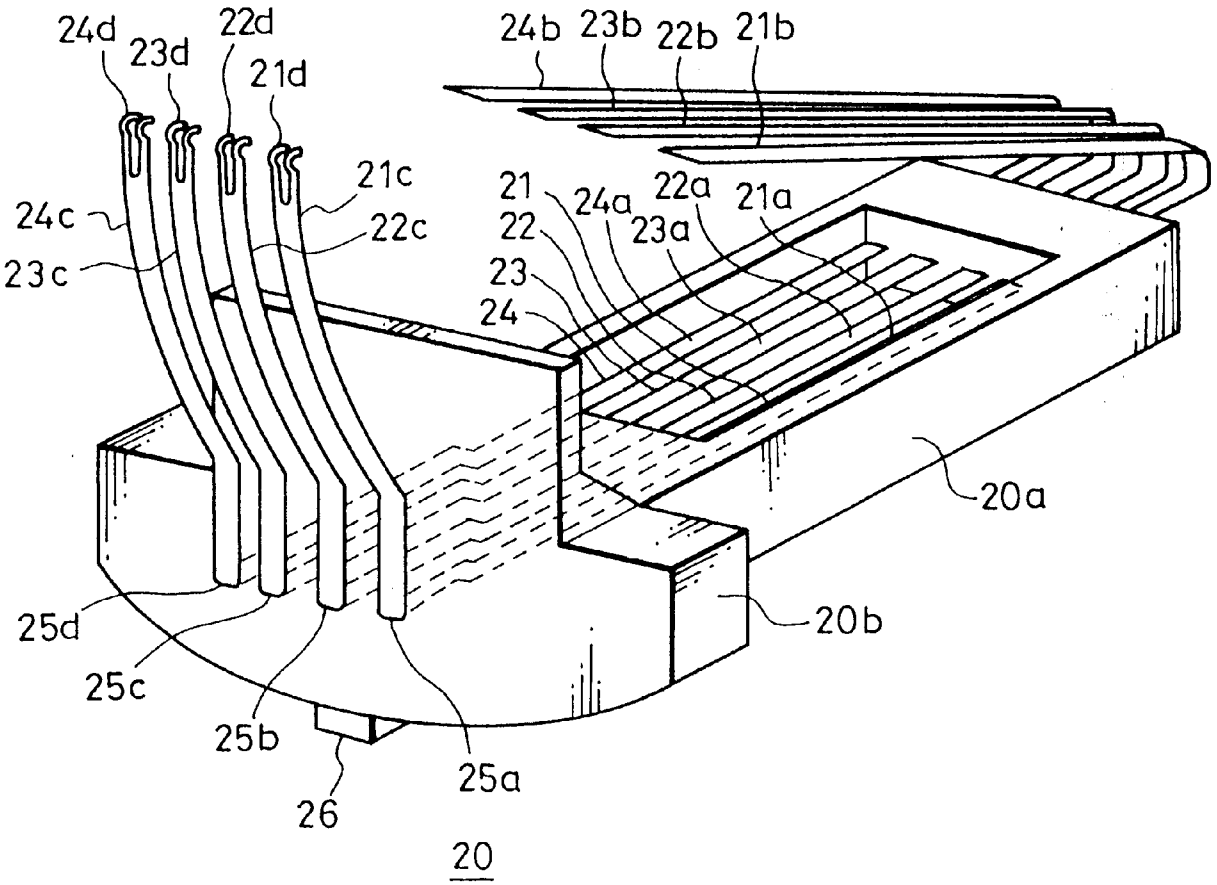
FIG. 9 is a perspective view illustrating an example of an arrangement of a terminal portion according to an embodiment of the present invention.

The terminal portion 20 of the modular socket 2 will be described with reference to FIG. 9, for example. As shown in FIG. 9, the terminal portion 20 comprises a terminal portion front portion 20*a* forming approximately a housing having a side surface of a predetermined thickness without an upper surface and a bottom surface, a terminal portion rear portion 20*b* in which a lower portion forms a part of a disk having approximately the same outer diameter as the inner diameter of the rear end portion 11 of the modular socket 2, an intermediate portion forms approximately a rectangular parallelepiped and an upper portion forms approximately a plate and the four modular terminals 21, 22, 23, 24. Also, the modular terminals 21, 22, 23, 24 include intermediate portions 21*a*, 22*a*, 23*a*, 24*a* penetrating the inside of the terminal portion front portion 20*a* and the terminal portion rear portion 20*b* in the front and rear direction, the inclined portions 21*b*, 22*b*, 23*b*, 24*b* and the erect portions 21*c*, 22*c*, 23*c*, 24*c*. In this embodiment, the rear portions of the intermediate portions 21*a*, 22*a*, 23*a*, 24*a* are respectively bent or curved to pass through terminal arrangement grooves 25*a*, 25*b*, 25*c*, 25*d* provided at the desired positions. In this embodiment, the terminal portion rear portion 20*b* has on its bottom portion provided an engagement protrusion 26.

Figure 10:
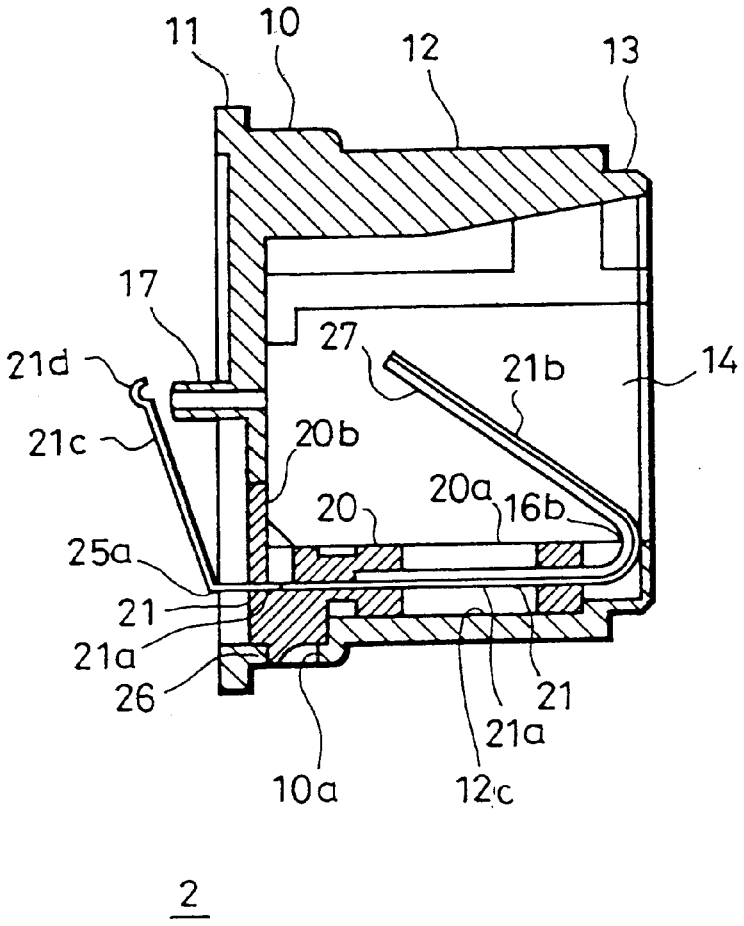
FIG. 10 is a cross-sectional view taken along the line X—X in FIG. 8, and illustrating an example of an arrangement of a modular socket according to an embodiment of the present invention.

Moreover, as shown in FIG. 10, in the modular socket 2, the engagement protrusion 26 formed on the lower portion of the terminal portion 20 is engaged with the inner surface of an engagement hole 10*a* bored in the lower portion of the modular socket rear portion 10 and the terminal portion front portion 20*a* is engaged with an engagement groove 12*c* which forms a groove of approximately a rectangular parallelepiped shape which is substantially the same in shape as that of the terminal portion 20*a*, thereby resulting in the terminal portion 20 being attached to the lower portion of the modular socket front portion 12. In this case, in this embodiment, of the front surface of the terminal portion front portion 20*a*, the left and right surfaces or the like except the surface of the central portion to which the modular terminals 21, 22, 23, 24 are protruded are engaged with the engagement groove 12*a*. In this embodiment, a band-shaped reinforcing plate 27 is disposed from each of the intermediate portions 21*a*, 22*a*, 23*a*, 24*a* of the modular terminals 21, 22, 23, 24 to each of the inclined portions 21*b*, 22*b*, 23*b*, 24*b* as shown in FIG. 10.

Figure 11:
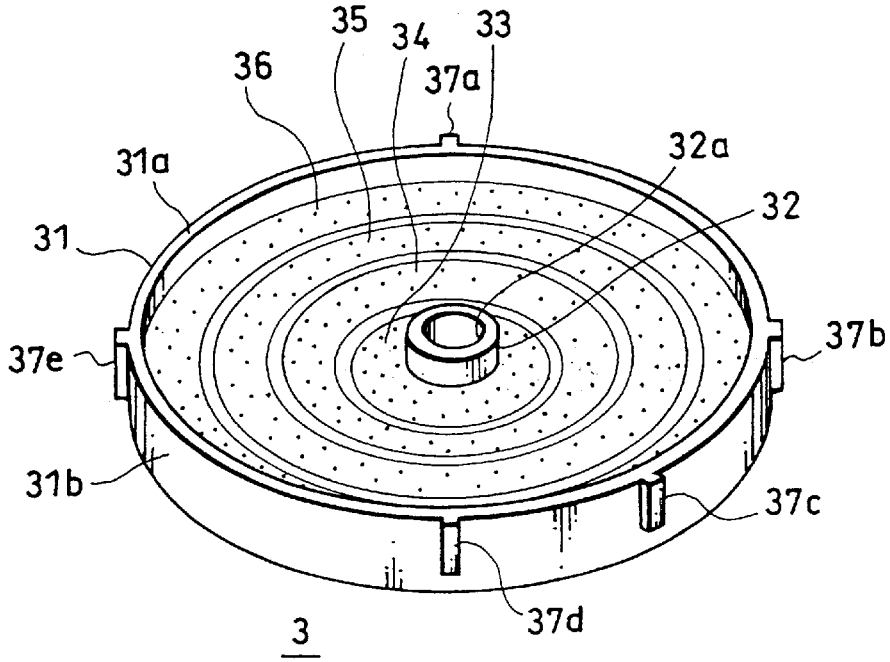
FIG. 11 is a perspective view illustrating an example of an arrangement of a connection member from the front side according to an embodiment of the present invention.

As shown in FIG. 11, for example, with respect to the surface of the side to which the modular socket 2 is joined, the connection member 3 comprises a cylindrical portion 31 having an outer diameter slightly larger than the rear end portion 11 of the modular socket 2 and whose inner diameter is substantially the same as that of the rear end portion 11 of the modular socket 2, a protruded portion 32 of a cylindrical shape having a vertical width approximately the same as that of the cylindrical portion 31 formed at the central portion of the axis of the connection member 3 and which has a joint hole 32*a* having an inner diameter slightly larger than the outer diameter of the protruded portion 17 of the modular socket 2 and four terminal plates 33, 34, 35, 36 of disk-like shapes formed on the inner wall of approximately the central positions of the front and rear direction of the cylindrical portion 31 and which are positioned concentrically. Incidentally, the cylindrical portion 31 has on its front surface formed a contact portion 31*a* of approximately a circular-band shape which contacts with the rear end portion 11 of the modular socket 2 upon assembly. Further, an outer wall portion 31*b* which is an outer wall portion of the cylindrical portion 31 includes five rotation-prevention protrusions 37*a*, 37*b*, 37*c*, 37*d*, 37*e*. The rotation-prevention protrusions 37*a*, 37*b*, 37*c*, 37*d*, 37*e* have predetermined widths shorter than the vertical width of the cylindrical portion 31 in the direction from the front end of the cylindrical portion 31 to the rear direction. Also, the respective terminal plates 33, 34, 35, 36 are formed at positions corresponding to the respective sliding contact portions 21*d*, 22*d*, 23*d*, 24*d* of the modular terminals 21, 22, 23, 24.

Figure 12:
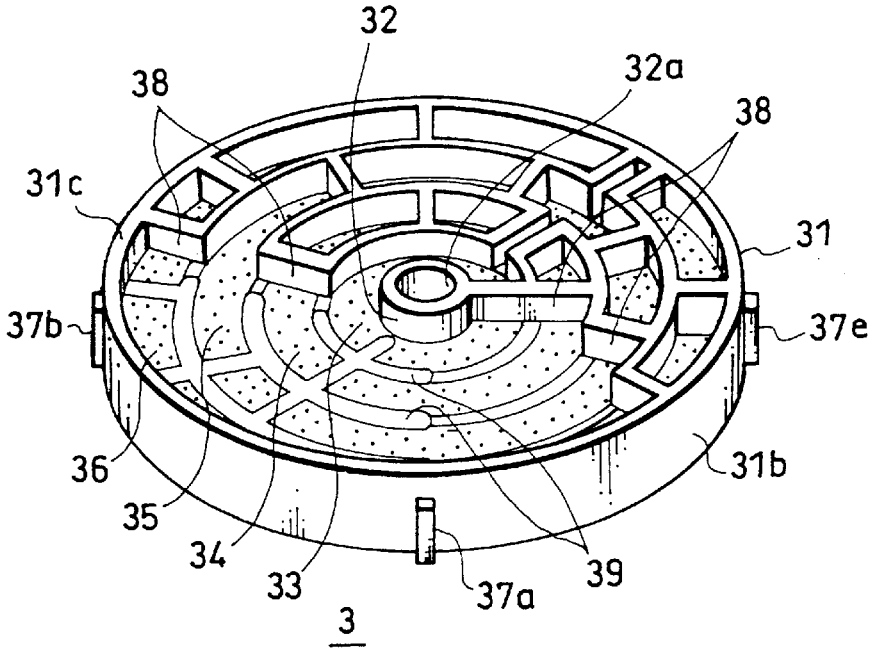
FIG. 12 is a perspective view illustrating an example of an arrangement of a connection member from the rear side according to an embodiment of the present invention.

As shown in FIG. 12, the connection member 3 has on its surface of the side to which the modular socket 2' is joined a joining portion 31*c* which is a portion where the connection member 3 is joined to the modular socket 2' On the surface of this joining portion 31*c* side, there are formed maze-like wall portions 38 by a synthetic resin, for example. The positions at which the wall portions 38 are formed are approximately the half of the surface to which the modular socket 2' is joined. In the range of approximately the remaining half, there are exposed the four terminal plates 33, 34, 35, 36 which are shaped as concentric circles. A member for holding the terminal plates 33, 34, 35, 36 is integrally molded with the connection member 3 by a synthetic resin.

As earlier described with reference to FIG. 6, the connector device 1 according to this embodiment includes the case front portion 4 for housing the modular socket 2 and the front half portion of the connection member 3 in a desired state and the case rear portion 5 for housing the rear half portion of the connection member 3 and the modular socket 2' in a desired state. These two cases 4, 5 house the two modular sockets 2, 2' and the connection member 3 in a desired state to construct the connector device according to this embodiment.

Figure 13:
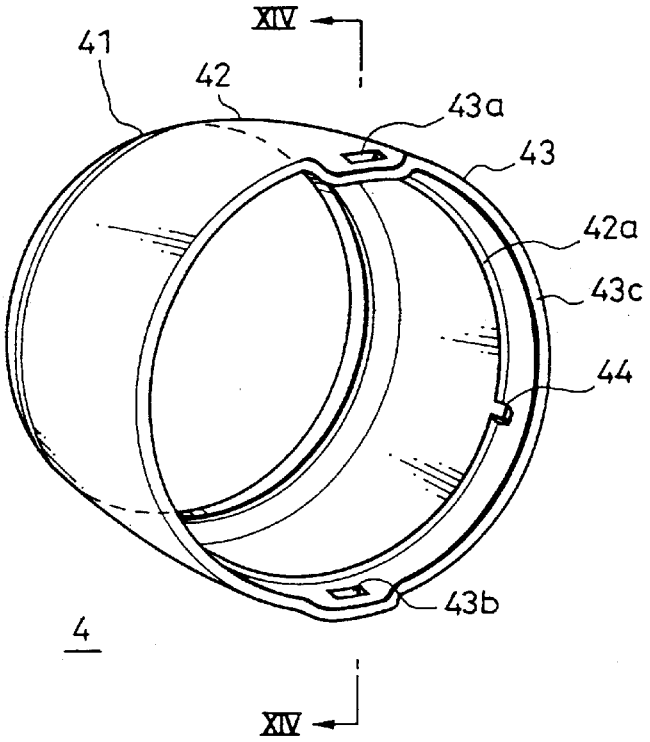
FIG. 13 is a perspective view illustrating an example of an arrangement of a case front portion according to an embodiment of the present invention.

The case front portion 4 is integrally molded by a synthetic resin in this embodiment. As shown in FIG. 13, the case front portion 4 has an outer configuration of approximately a frustum of circular cone in the front and rear direction and is hollow in the front and rear direction. The case front portion 4 comprises a front end portion 41 having an inner diameter slightly larger than the outer diameter of the front end portion 13 of the modular socket 2, a socket housing portion 42 for housing themodular socket front portion 12, the modular socket rear portion 10 and the portion of the rear end portion 11 and a rear end portion 43 having a predetermined inner diameter. A boundary portion between the socket housing portion 42 and the rear end portion 43 has on its inner wall a predetermined stepped difference portion 42*a*. The rear end portion 43 forms portions rearwardly extended from other portions at the two positions in the upper and lower direction. Engagement holes 43*a*, 43*b* for joining the case front portion 4 to the case rear portion 5 are bored through such extended portions, respectively. In this embodiment, at a desired position of the inner wall of the rear end portion 43, there is formed a positioning protrusion 44 protruded toward the center of the axis. This positioning protrusion 44 is rearwardly protruded from a predetermined one portion of the stepped difference portion 42*a* and is formed on the inner wall surface of the rear end portion 43.

Figure 14:
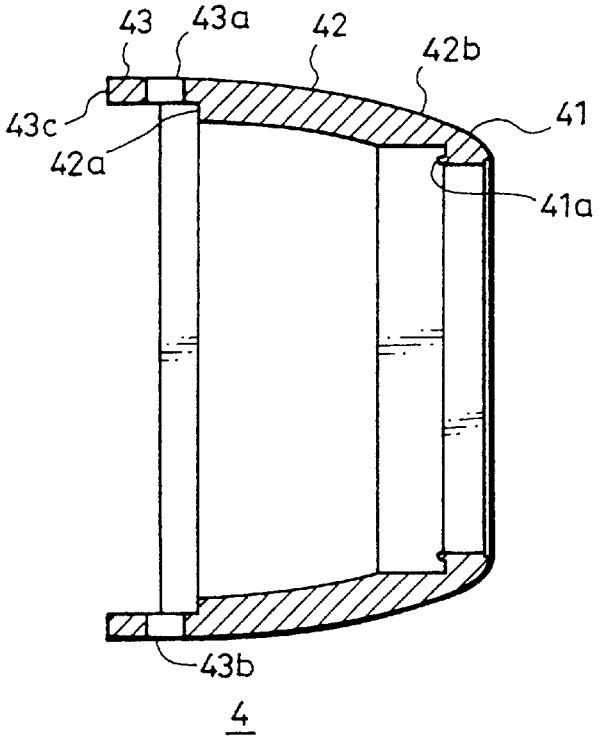
FIG. 14 is a cross-sectional view taken along the line XIV—XIV in FIG. 13, and illustrating an example of an arrangement of a case front portion according to an embodiment of the present invention.

As shown in a cross-sectional view of FIG. 14, in the case front portion 4, the inner wall surface of the front end portion 41 is slightly protruded backwardly around the whole circumference thereof to form a protruded portion 41*a*. This protruded portion 41*a* comes in contact with a circular-band-shaped surface formed by the stepped difference between the modular socket front portion 12 and the front end portion 13 of the modular socket 2 when the modular socket 2 is housed in the case front portion 4. The inner diameter of a socket housing portion front portion 42*b* forming the front half portion of the socket housing portion 42 is made slightly larger than the outer diameter of the modular socket front portion 12. The socket housing portion front portion 42*b* houses approximately the front half portion of the modular socket front portion 12 when the modular socket 2 is housed. The width of the socket housing portion 42 in the front and rear direction is determined in such a manner that the positions of the stepped difference portion 42*a* and the rear end of the modular socket 2 become coincident with each other with respect to the front and rear direction when the modular socket 2 is housed. The inner diameter of the stepped difference portion 42*a* is made slightly larger than the outer diameter of the rear end portion 11 of the modular socket 2.

Figure 15:
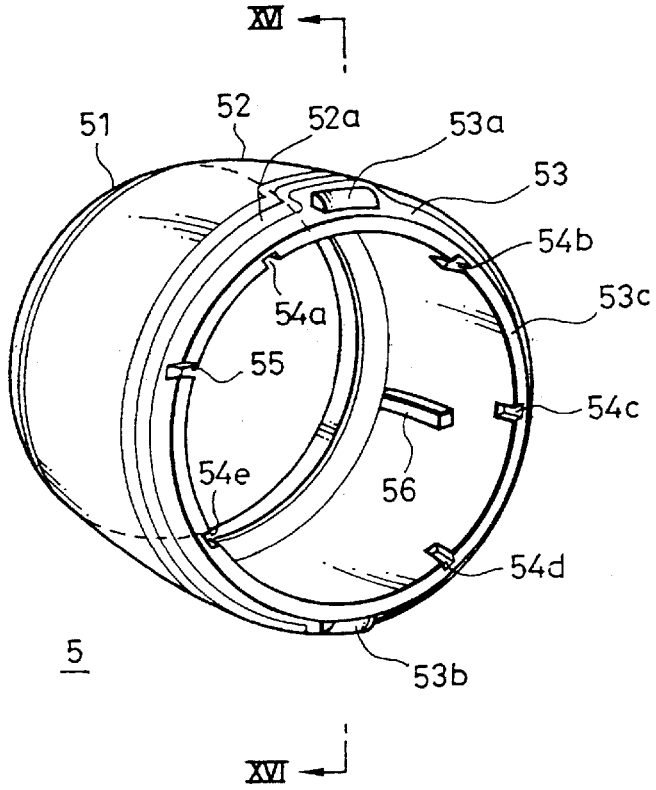
FIG. 15 is a perspective view illustrating an example of an arrangement of a case rear portion according to an embodiment of the present invention.

The case rear portion 5 is integrally molded by a synthetic resin in this embodiment. As shown in FIG. 15, the case rear portion 5 has an outer configuration of approximately a frustum of circular cone in the front and rear direction and is hollow in the front and rear direction. The case rear portion 5 according to this embodiment comprises a rear end portion 51, a socket housing portion 52 and a front end portion 53. In this embodiment, in this case rear portion 5, in order to house the modular socket 2' which is approximately the same as that modular socket 2, the rear end portion 51 is shaped in substantially the same manner as the front end portion 41 of the case front portion 4, and the socket housing portion 52 is shaped in substantially the same manner as the socket housing portion 42 of the case front portion 4. The front end portion 53 has approximately a cylindrical shape having an outer diameter slightly smaller than the inner diameter of the rear end portion 53 and which has an inner diameter slightly larger than the outer diameter of the cylindrical portion 31 of the connection member 3. Incidentally, the front end portion 53 has upper and lower two portions wider than those of other portions in the rearward direction, and coupling protrusions 53*a*, 53*b* for coupling the case rear portion 5 to the case front portion 4 are formed on such wide portions.

The boundary portion between the socket housing portion 52 and the front end portion 53 forms a predetermined stepped difference portion 52*a* along the outer wall. This stepped difference portion 52 is shaped in such a manner as to contact with the end face 43*c* of the rear end portion of the case front portion 4 without a substantial clearance therebetween. Also, in this embodiment, on the inner wall of the socket housing portion 52, there are formed five rotation-prevention grooves 54*a*, 54*b*, 54*c*, 54*d*, 54*e* in correspondence with the rotation-prevention protrusions 37*a*, 37*b*, 37*c*, 37*d*, 37*e* of the connection member 3. The front end of the front end portion 53 is shaped in such a manner as to contact with the stepped difference portion 42*a* of the case front portion 4 without a substantial clearance. Further, in this embodiment, on the inner wall of the front end portion 53, there is formed a positioning groove 55 corresponding to the positioning protrusion 44 of the case front portion 4. Also, on the inner wall of the socket housing portion 52, there is formed a protruded portion 56 which is fitted into the groove 18' of the housed modular socket 2'.

Figure 16:
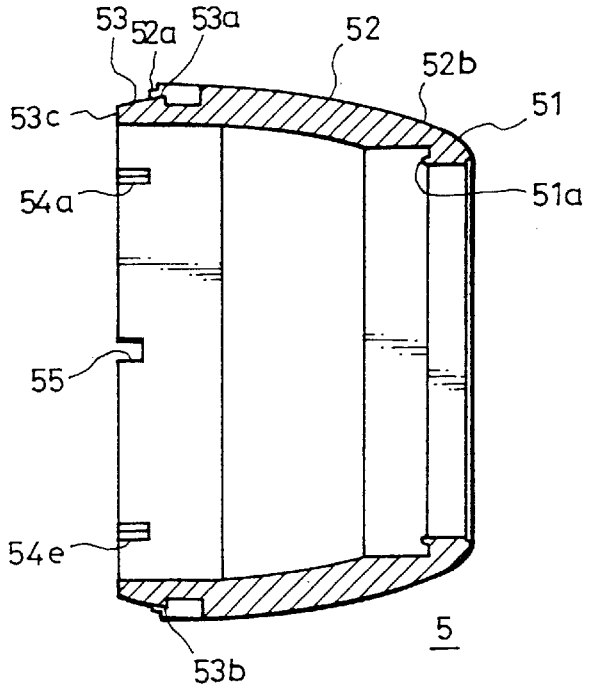
FIG. 16 is a cross-sectional view taken along the line XVI—XVI in FIG. 15, and illustrating an example of an arrangement of a case rear portion according to an embodiment of the present invention.

As shown in a cross-sectional view of FIG. 16, the case rear portion 5 has a protruded portion 51*a* which is formed by slightly protruding the inner wall surface of the rear end portion 51 around the whole circumference in the front direction. The protruded portion 51*a* has approximately the same shape as that of the protruded portion 41*a* of the case front portion 4. The housing portion rear portion 52*b* forming the rear half portion of the socket housing portion 52 has approximately the same shape as that of the housing portion front portion 42*b* of the case front portion 4. Incidentally, the socket housing portion 52 determines its width and so on in the front and rear direction in exactly the same manner as the socket housing portion 42 of the case front portion 4.

The assemble process of the connector device according to this embodiment will be described with reference to FIG.

Figure 17:
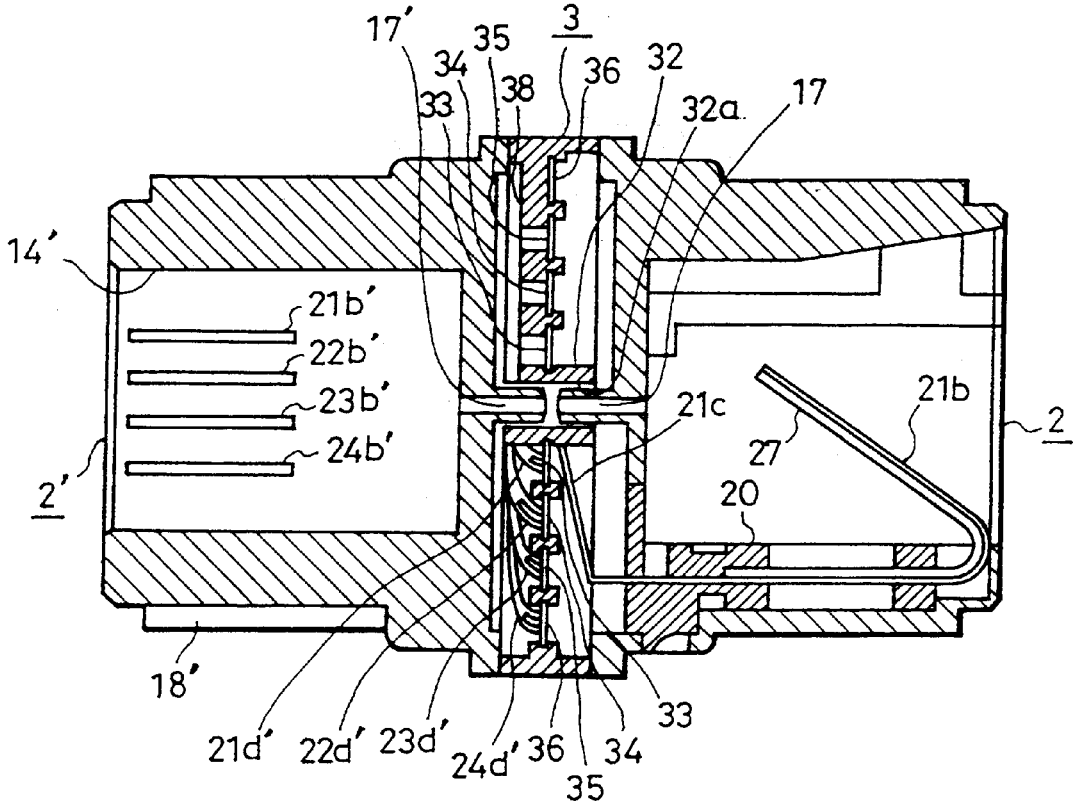
FIG. 17 is a cross-sectional view illustrating the condition that the connector device is connected according to an embodiment of the present invention.

17. As shown in FIG. 17, the front surface of the modular socket 2' and the rear surface of the connection member 3 are joined to each other. In this joint, the protruded portion 17' of the modular socket 2' is inserted into the joint hole 32*a* of the connection member 3 so as to keep the same coaxial, and the joining portion 31*c* of the connection member 3 is bonded to the rear end portion 11' of the modular socket 2' by a suitable means such as an adhesive. At that time, the sliding contact portions 21*d*', 22*d*', 23*d*', 24*d*' of the modular terminals 21', 22', 23', 24' are respectively brought in contact with the corresponding terminal plates 33, 34, 35, 36 and then connected together electrically.

Then, the modular socket 2' and the connection member 3 that are made integral by the bonding are housed into the case rear portion 5. When themodular socket 2' and the connection member 3 are housed into the case rear portion 5, the rotation-prevention protrusions 37*a*, 37*b*, 37*c*, 37*d*, 37*e* of the connection member 3 are engaged with the rotation-prevention grooves 54*a*, 54*b*, 54*c*, 54*d*, 54*e* of the case rear portion 5, respectively. At that time, the stepped difference surface between the modular socket front portion 12 and the front end portion 13 of the modular socket 2' contacts with the protruded portion 51*a* of the case rear portion 5, and the rear end of the case rear portion 5 and the rear end of the modular socket 2' agree with each other approximately. Also, the end face 53*c* of the case rear portion 5 and the connection portion 31*a* of the connection member 3 agree with each other in the front and rear direction. Further, the protruded portion 56 on the inner wall of the case rear portion 5 is fitted into the groove 18' of the modular socket 2', whereby the modular socket 2' and the connection member 3 are housed in the case rear portion 5 of the modular socket 2' in such a manner that they can be prevented from being rotated.

Then, the protruded portion 17 of the modular socket 2 is inserted into the joint hole 32 of the connection member 3 housed in the case rear portion 5 to thereby keep the both coaxial. Then, the case front portion 4 is coupled to the case rear portion 5 in such a manner that the case front portion 4 covers the modular socket 2. When the case front portion 4 is coupled to the case rear portion 5, the positioning protrusion 44 of the case front portion 4 is engaged with the positioning groove 55 of the case rear portion 5, and at the same time the coupling holes 43*a*, 43*b* of the case front portion 4 are engaged with the coupling protrusions 53*a*, 53*b* of the case rear portion 5, respectively. At that time, the circular-band-shaped surface of the rear end of the modular socket 2 and the sliding contact portion 31*a* of the connection member 3 are brought in contact with each other, and the sliding contact portions 21*d*, 22*d*, 23*d*, 24*d* of the modular terminals 21, 22, 23, 24 of the modular socket 2 are brought in contact with the corresponding terminal plates 33, 34, 35, 36 at two points, respectively. Also, the modular socket 2 can be freely rotated with respect to the cases 4, 5 and the like around the axis direction. When the modular socket 2 is rotated, the terminal plates 33, 34, 35, 36 and the sliding contact portions 21*d*, 22*d*, 23*d*, 24*d* are constantly contacted with one another at two points, respectively.

The connector device thus assembled is shaped like a barrel as shown in FIG. 6. In this embodiment, in the inside of the case front portion 4 and the case rear portion 5 thus jointed, there are provided the connection member 3 and the modular connector 2' which are prevented from being rotated with respect to the case front portion 4 and the case rear portion 5, and the modular connector 2 connected to the connection member 3 in such a manner that it can be freely rotated with respect to the case front portion 4 and the case rear portion 5. Also, the front and rear connector coupling recesses 14, 14' are exposed to be contacted to the outside.

The manner in which the connector device 1 is used will be described below. For example, the modular socket 2 is coupled to the modular connector provided at one end of the curl cord, and the modular connector 2' is connected to the telephone body through the plug device 6 having the modular connectors 62, 63 at the front and rear portions. In this manner, the curl cord can be freely rotated around the axis direction with respect to the modular connector coupled to the modular socket 2'. When the curl cord is rotated, the terminal plates 33, 34, 35, 36 and predetermined contact portions of the sliding contact portions 21*d*, 22*d*, 23*d*, 24*d* of the corresponding modular terminals 21, 22, 23, 24 are constantly brought in contact with one another in such a manner that they may be slid relatively. That is, when a twisting force is applied to the curl cord or the modular connector coupled to the modular socket 2' or either of them, the curl cord can be rotated together with the modular socket 2 while keeping an electrical connection, thereby preventing the curl cord from being twisted.

According to the above-mentioned arrangement, without using expensive assemblies, it is possible to prevent the telephone cord from being twisted by the simple arrangement. Also, since the sliding contact portions 21*d*, 22*d*, 23*d*, 24*d* of the modular terminals 21, 22, 23, 24 are bifurcated and brought in contact with the corresponding terminal plates 33, 34, 35, 36 at two points, respectively, even when the contact of any one point is broken and the sliding contact portions 21*d*, 22*d*, 23*d*, 24*d* can be satisfactorily contacted with the terminal plates 33, 34, 35, 36, thereby making it possible to prevent a noise from being caused due to the unsatisfactory contacts between the contact portions. Further, since the contact portions of the front and rear modular terminals 21, 22, 23, 24 and 21', 22', 23', 24' are formed as the same assemblies (front and rear of the terminal plates 33, 34, 35, 36 in this embodiment) and the two modular sockets 2, 2' are formed as approximately the same structure, it is possible to suppress the number of interposed assemblies to the minimum, and the occurrence of noises can be prevented.

Also, in the case of this embodiment, as shown in FIG. 6, since the connector device 1 and the plug device 6 are formed as the separate devices, only the connector device 1 is used and two telephone cords are connected to the front and the rear of the connector device 1, whereby the telephone cord can be extended to a desired length. Also in this case, it is possible to prevent the telephone cord from being twisted.

While the above-mentioned embodiment of the present invention includes the two modular sockets in the front and rear sides as described above, the present invention is not limited thereto, and instead of one modular socket, the modular socket, for example, is arranged such that the connector portion may be protruded from the case and may be directly connected to the telephone body. In this case, any modular connector may be used as long as the modular connector can be housed in the case and can be positively connected to the terminal plates of the connection a member electrically. Incidentally, while the sliding contact portions are bifurcated as described above, the sliding contact portions are not limited to the bifurcated sliding contact portions and the sliding contact portions may be divided into more than two so as to have many contacts. Alternatively, the sliding contact portions need not be bifurcated.

While the two modular sockets having approximately the same arrangement are used in the above-mentioned embodiment, the two modular sockets need not always be arranged in exactly the same manner. When one modular socket is coupled to the case and the connection member so as not to rotate, as long as the modular socket maybe connected electrically with a reliability, the modular socket may not have sliding contact portions of the modular terminals or the like.

The connector device according to the present invention is not limited to the above-mentioned embodiment and can of course take various modifications and variations.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A connector device comprising:

first and second cases fixedly attached to each other;

first and second sockets housed respectively within said first and second cases and having on a front surface side of said first socket a first recess portion for receiving a respective modular connector and having on a front surface side of said second socket a second recess portion for receiving a respective modular connector, said first socket being rotatable within said first case;

a first plurality of electrical conductors arranged in said first socket and having first ends formed as modular terminals extending into said first recess and having second ends formed as first contacts resiliently protruded to different positions from a rear surface side of said first socket;

a second plurality of electrical conductors arranged in said second socket and having first ends formed as modular terminals extending into said second recess and having second ends formed as second contacts resiliently protruded to different positions from a rear surface side of said second socket; and a disk-shaped connection member having a first surface and a second surface respectively opposed to the rear surface sides of said first and second sockets, said connection member being disposed within said first and second cases at a junction thereof so as to become coaxial with said first and second sockets and having on said first surface a plurality of annular terminal plates which continuously respectively contact with said plurality of first contacts of said first plurality of electrical conductors arranged in said first socket when said first socket is rotated within said first case, wherein reverse sides of said plurality of annular terminal plates of said disc-shaped connection member are partially exposed on said second surface of said disk-shaped connection member and make contact with said second contacts of said second plurality of electrical conductors arranged in said second socket.

2. The connector device as claimed in claim 1, wherein tip ends of said plurality of first contacts of said first socket are extended to different radial positions and said plurality of annular terminal plates are disposed in concentric circles of different respective diameters.

3. The connector device as claimed in claim 1, wherein said plurality of first contacts of said first socket are extended so that each forms a part of a circumference of a respective circle.

4. The connector device as claimed in claim 1, wherein said first and second sockets and said first and second cases are cylindrical and said connection member has a disk-like shape.

* * * * *